US008616286B2

(12) United States Patent
Papon et al.

(10) Patent No.: US 8,616,286 B2
(45) Date of Patent: Dec. 31, 2013

(54) RISER PIPE WITH ADJUSTABLE AUXILIARY LINES

(75) Inventors: Gérard Papon, Les Essarts Leroi (FR); Emmanuel Persent, Croissy sur Seine (FR)

(73) Assignee: IFP, Rueil Malmaison (FR)

( * ) Notice: Subject to any disclaimer, the term of this patent is extended or adjusted under 35 U.S.C. 154(b) by 774 days.

(21) Appl. No.: 12/788,468

(22) Filed: May 27, 2010

(65) Prior Publication Data

US 2010/0300699 A1 Dec. 2, 2010

(30) Foreign Application Priority Data

May 29, 2009 (FR) ..... 09 02624

(51) Int. Cl.
*E21B 7/12* (2006.01)

(52) U.S. Cl.
USPC ..... 166/338; 166/339; 166/340; 166/341

(58) Field of Classification Search
USPC ..... 166/338, 339, 340, 341, 344, 345, 367, 166/351, 360
See application file for complete search history.

(56) References Cited

U.S. PATENT DOCUMENTS

| | | | | |
|---|---|---|---|---|
| 3,952,526 | A | 4/1976 | Watkins et al. | |
| 4,374,595 | A * | 2/1983 | Watkins | 285/123.2 |
| 4,397,357 | A * | 8/1983 | Hettinger | 166/345 |
| 4,496,173 | A * | 1/1985 | Roche et al. | 285/24 |
| 4,662,785 | A * | 5/1987 | Gibb et al. | 405/195.1 |
| 5,390,966 | A * | 2/1995 | Cox et al. | 285/124.2 |
| 5,657,823 | A | 8/1997 | Kogure et al. | |
| 5,660,233 | A * | 8/1997 | Sparks | 166/367 |
| 6,123,151 | A * | 9/2000 | Regan et al. | 166/367 |
| 6,129,151 | A * | 10/2000 | Crotwell | 166/359 |
| 6,401,825 | B1 * | 6/2002 | Woodrow | 166/350 |
| 6,419,277 | B1 * | 7/2002 | Reynolds | 285/123.1 |
| 6,623,044 | B1 * | 9/2003 | Guesnon et al. | 285/124.1 |
| 6,991,038 | B2 * | 1/2006 | Guesnon et al. | 166/345 |
| 7,720,432 | B1 | 5/2010 | Colby et al. | |
| 2011/0073315 | A1 * | 3/2011 | Guesnon et al. | 166/367 |

FOREIGN PATENT DOCUMENTS

| | | |
|---|---|---|
| EP | 0 039 589 A2 | 11/1981 |
| FR | 2 432 672 | 2/1980 |
| FR | 2 464 426 | 3/1981 |
| FR | 2 526 517 | 11/1983 |
| FR | 2 543 611 | 10/1984 |
| FR | 2 799 789 | 4/2001 |
| FR | 2 860 828 | 4/2005 |
| FR | 2 891 579 A1 | 4/2007 |
| GB | 2 077 812 | 12/1981 |

* cited by examiner

*Primary Examiner* — Matthew Buck
*Assistant Examiner* — Aaron Lembo
(74) *Attorney, Agent, or Firm* — Antonelli, Terry, Stout & Kraus, LLP.

(57) ABSTRACT

The riser pipe section comprises a main tube 22 and auxiliary line elements 23 arranged parallel to tube 22. The ends of the main tube comprise connectors 20*a* and 20*b* allowing longitudinal stresses to be transmitted. The ends of auxiliary line elements 23 comprise connectors 20*c* and 20*d*.
Auxiliary line elements 23 consist of two parts 23*a* and 23*b* assembled by an adjustment device 23*c* or 30 allowing the axial length of each auxiliary line element to be adjusted.

18 Claims, 5 Drawing Sheets

RISER PIPE WITH ADJUSTABLE AUXILIARY LINES

FIELD OF THE INVENTION

The present invention relates to the field of very deep sea drilling and oil reservoir development. It concerns a riser pipe element comprising at least one line, or rigid auxiliary line, which can transmit tensional stresses between the top and the bottom of the riser.

BACKGROUND OF THE INVENTION

A drilling riser is made up of an assembly of tubular elements whose length generally ranges between 15 and 25 m, assembled by connectors. The weight of the riser borne by an offshore platform can be very great, which requires suspension means of very high capacity at the surface and suitable dimensions for the main tube and the connection fittings.

So far, the auxiliary lines: kill lines, choke lines, booster lines and hydraulic lines are arranged around the main tube and they comprise insertable fittings fastened to the riser element connectors in such a way that these high-pressure lines can allow a longitudinal relative displacement between two successive line elements, without any disconnection possibility however. Owing to these elements mounted sliding into one another, the lines intended to allow high-pressure circulation of an effluent coming from the well or from the surface cannot take part in the longitudinal mechanical strength of the structure consisting of the entire riser.

Now, in the perspective of drilling at water depths that can reach 3500 m or more, the dead weight of the auxiliary lines becomes very penalizing. This phenomenon is increased by the fact that, for the same maximum working pressure, the length of these lines requires a larger inside diameter considering the necessity to limit pressure drops.

Document FR-2,891,579 aims to involve the auxiliary lines, kill lines, choke lines, booster lines or hydraulic lines, in the longitudinal mechanical strength of the riser. According to this document, the tubes that make up an auxiliary line are assembled end to end by rigid connections allowing longitudinal stresses to be transmitted between two tubes. Thus, the auxiliary line forms a rigid assembly that affords the advantage of transmitting stresses between the top and the bottom of the riser.

One difficulty in achieving the riser according to document FR-2,891,579 lies in the assembly of two riser sections T1 and T2 shown in FIG. 1. When installing a riser at sea, section T1 is assembled end to end to section T2 of the riser. To connect them, connector C1 of main tube TB, respectively fastening means C2 and C3 of each auxiliary line tube TA, have to exactly coincide with connector C1', respectively fastening means C2' and C3', of the section to be connected. Now, the manufacturing tolerances of the tubes of the main line or of the auxiliary lines can be several centimeters on 15 to 25-m long tubes. Furthermore, the welds performed between the connecting means and the tubes can increase the length difference between the various tubes of a riser section. For example, in FIG. 1, connector C1' and fastening means C2' and C3' are aligned in plane P'. On the other hand, connector C2 is set back by an axial distance D1 with respect to plane P of connector C1 and connector C3 protrudes by an axial distance D2 with respect to plane P. Consequently, when connecting section T1 to section T2, while fastening means C3 abuts in C3', connector C1 is only partly inserted in connector C1' and fastening means C2 cannot cooperate with means C2'. The offsets in the axial position of the connectors, due to the length differences of the tubes, can make connection impossible.

The present invention aims to provide at least one of the tubes that make up the auxiliary lines with adjustment means for adjusting the axial length of the tube in order to achieve connection of the tubes between two riser sections.

SUMMARY OF THE INVENTION

In general terms, the invention relates to a riser section comprising a main tube, at least one auxiliary line element arranged substantially parallel to said tube. The main tube comprises connecting means allowing longitudinal stresses to be transmitted and the auxiliary line element comprises, linking means. The riser section is characterized by the fact that the auxiliary line element is made up of two parts assembled by an adjustment device allowing to modify the axial length measured between the ends of said auxiliary line element.

According to the invention, the adjustment device can comprise a screw-nut system. For example, a nut rests against a shoulder provided on one of the two parts of the auxiliary line element and the nut is screwed onto a thread provided on the other part of the auxiliary line element. Furthermore, a locking means can block the nut in rotation.

The adjustment device can comprise a male end piece and a female end piece, the male end piece can cooperate with the female end piece so as to achieve a sealed connection between the two tube sections.

Alternatively, the adjustment device can comprise a sleeve including a first internal thread that cooperates with the first thread provided in one of the two parts of the auxiliary line element, the sleeve comprising a second internal thread that cooperates with a second thread provided in the other part of the auxiliary line element, the first thread being reversed with respect to the second thread. A locking means can block the sleeve in rotation. Seal means can be arranged between the parts of the auxiliary line element and the sleeve.

The auxiliary line element can be secured to the main tube.

The connecting means can consist of a bayonet locking system.

The linking means can allow to transmit longitudinal stresses. The linking means can be selected among the group consisting of a bayonet locking system, a screwing system, a "dog" lock system. Alternatively, the linking means can comprise a male end piece and a female end piece, the male end piece being suited to slide in the female end piece.

The connecting means can comprise a first rotating locking element, the linking means can comprise a second rotating locking element, and the rotation of the first locking element can cause rotation of the second locking element.

The bayonet locking system can comprise a male tubular element and a female tubular element that fit into one another and have an axial shoulder for longitudinal positioning of the male tubular element in relation to the female tubular element, a locking ring mounted mobile in rotation on one of the tubular elements, the ring comprising studs that cooperate with the studs of the other tubular element so as to form a bayonet joint.

The main tube can be a steel tube hooped by composite strips. The auxiliary line element can consist of steel tubes hooped by composite strips. Said composite strips can comprise glass fibers, carbon fibers or aramid fibers coated with a polymer matrix.

Alternatively, the auxiliary line element can be made of a material selected from the list consisting of a composite material comprising reinforcing fibers coated with a polymer matrix, an aluminium alloy, a titanium alloy.

The invention also relates to a riser comprising at least two riser sections according to the invention as described above. The sections are assembled end to end. An auxiliary line element of a section can transmit longitudinal stresses to the auxiliary line element of the other section to which it is assembled.

BRIEF DESCRIPTION OF THE FIGURES

Other features and advantages of the invention will be clear from reading the description hereafter, with reference to the accompanying figures wherein.

DETAILED DESCRIPTION

Figure 1:
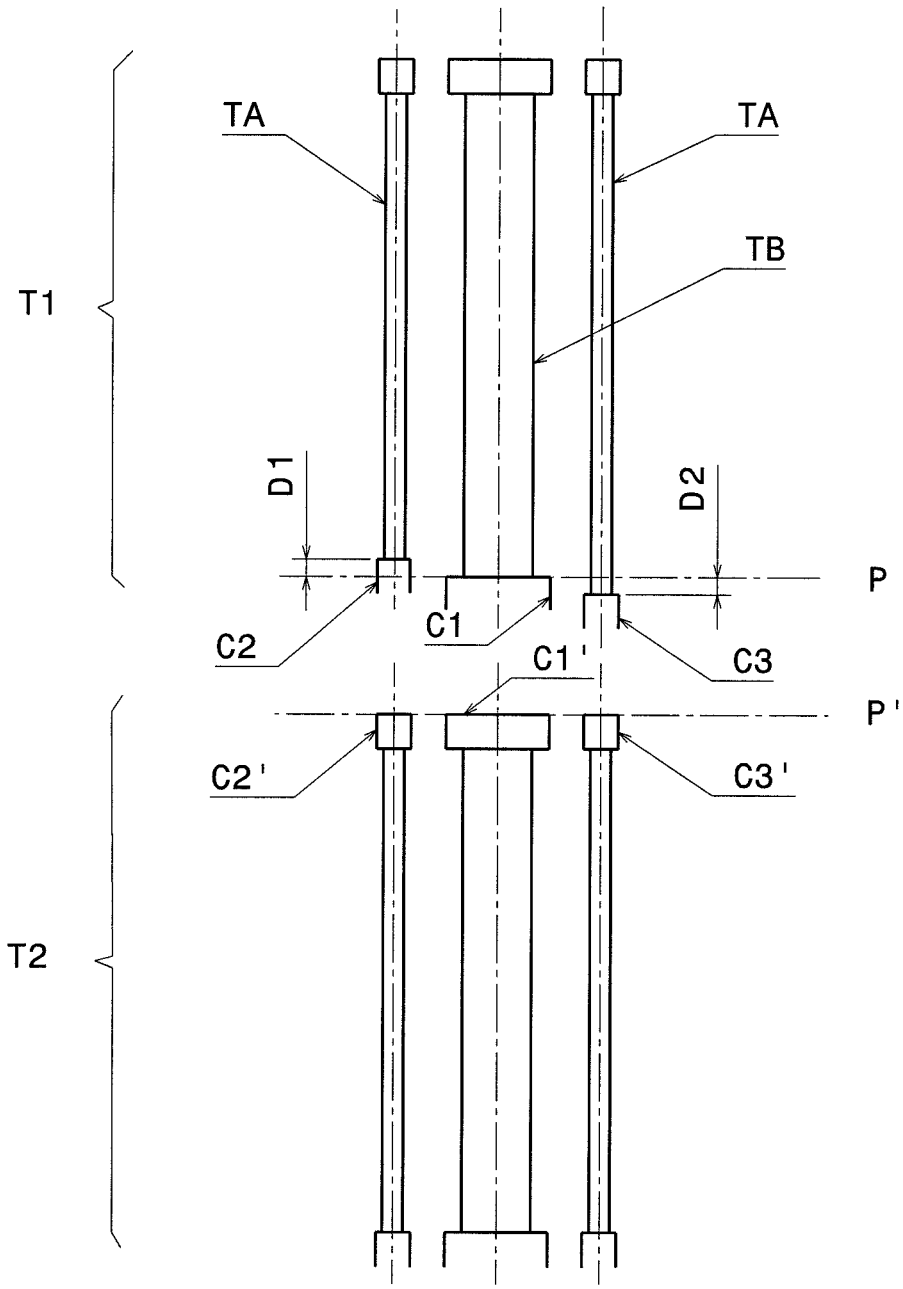
FIG. 1 diagrammatically shows two riser sections being assembled.
Figure 2:
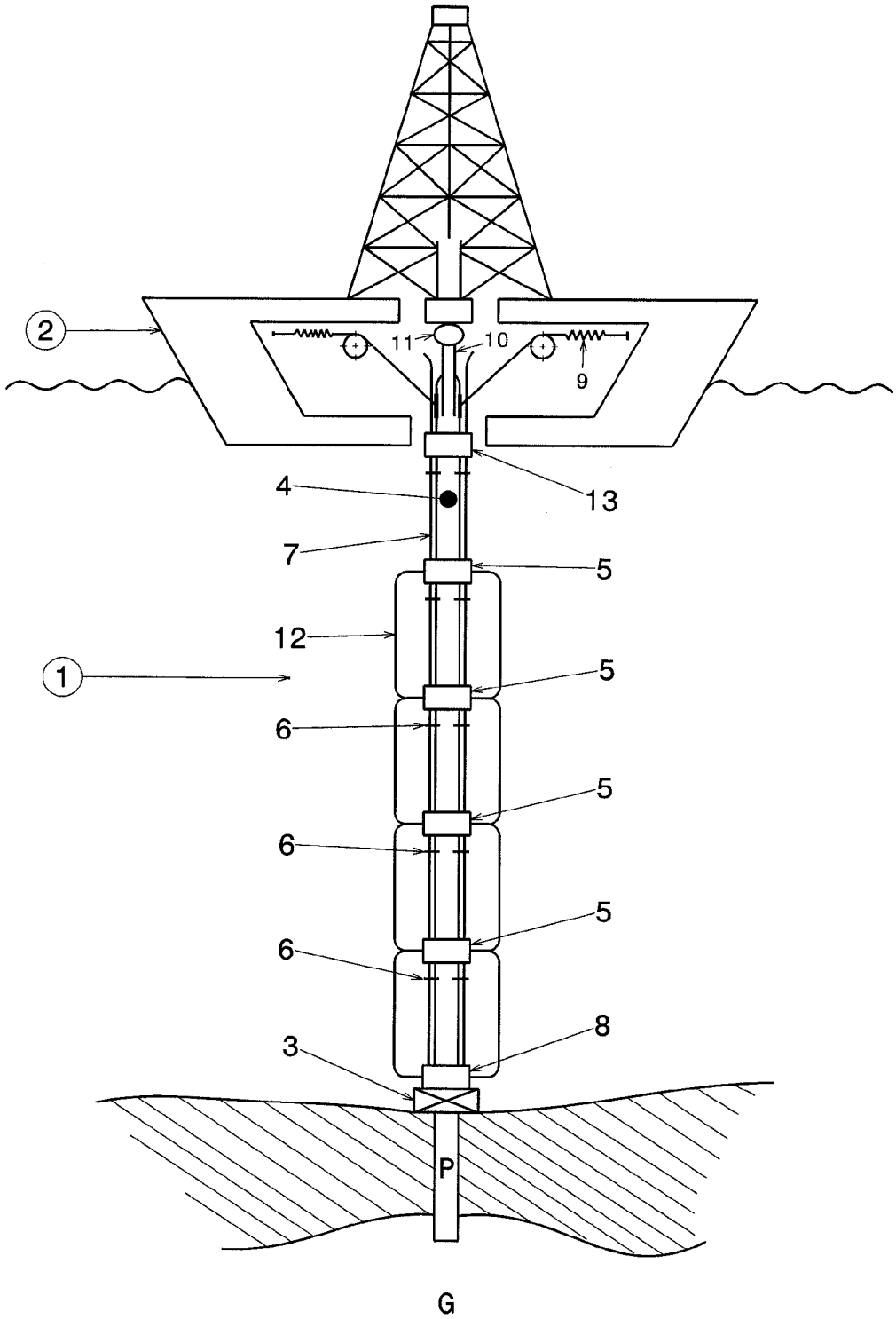
FIG. 2 diagrammatically shows a riser.

FIG. 2 diagrammatically shows a riser 1 installed at sea, intended for drilling a well P for development of reservoir G. Riser 1 forms an extension of well P and it extends from wellhead 3 to floater 2, a floating platform, a barge or a vessel for example. Wellhead 3 is provided with preventers commonly referred to as "BOPs" or "Blow-Out Preventers".

The riser diagrammatically shown in FIG. 2 comprises a main tube 4 and auxiliary lines 7.

With reference to FIG. 2, auxiliary lines 7 are arranged parallel to and on the periphery of main tube 4 consisting of the assembly of tubes. The auxiliary lines referred to as kill line and choke line are used for circulating fluids between the well and the surface, or vice versa, when the BOPs are closed notably in order to allow control procedures relative to the inflow of fluids under pressure in the well. The auxiliary line referred to as booster line allows mud to be injected at the bottom of the riser. The auxiliary line(s) referred to as hydraulic line(s) allow to transfer a fluid under pressure for controlling the BOPs of the wellhead.

The auxiliary lines are made up of several tube sections 7 fastened to the main tube elements and assembled at the level of connectors 5.

In the lower part, riser 1 is connected to wellhead 3 by means of the LMRP or Lower Marine Riser Package 8. The link between connecting means 8 and the riser can comprise a joint, commonly referred to as ball joint or flex joint, which allows an angular travel of several degrees.

In the upper part, riser 1 is fastened to floater 2 by a system of tensioners 9 consisting, for example, of an assembly of hydraulic jacks, oleopneumatic accumulators, transfer cables and idler sheaves.

The hydraulic continuity of riser 1 up to the rig floor is provided by a system of sliding tubes 10, commonly referred to as slip joint, and by a joint 11 allowing an angular travel of several degrees.

Floats 12 in form of syntactic foam modules or made of other materials of lower density than sea water are fastened to main tube 4. Floats 12 allow to lighten riser 1 when it is immersed and to reduce the tension required at the top of the riser by means of the tensioners.

The main tube and each auxiliary line 7 are connected to wellhead 3 by connectors 8 and to sliding tube system 10 by connectors 13, connectors 13 and 8 transmitting the longitudinal stresses from the tensioners secured to the floater to the wellhead through the riser. Connecting means 5 allow to achieve rigid links between the riser elements. Means 5 allow to achieve a rigid link between two main tube elements. Thus, the main tube forms a mechanically rigid assembly that withstands the longitudinal stresses between wellhead 3 and floater 2. Consequently, the longitudinal stresses applied to the riser are distributed among main tube 4 and the various auxiliary lines 7. Alternatively, means 5 allow to achieve a sealed link between two auxiliary line tubes, however means 5 transmit no longitudinal stresses between two auxiliary line tubes.

Furthermore, each element of an auxiliary line 7 is secured to main tube 4 by fastening means 6 generally arranged close to connectors 5. These fastening means allow the auxiliary tubes to be positioned with respect to the main tube so as to fix the axial and radial position of the connectors. Furthermore, means 6 can be suited to distribute or to balance the stresses among the various auxiliary lines and the main tube, notably if the deformations between the auxiliary lines and the main tube are not equal, for example in case of a pressure and temperature variation between the various lines.

Figure 3:
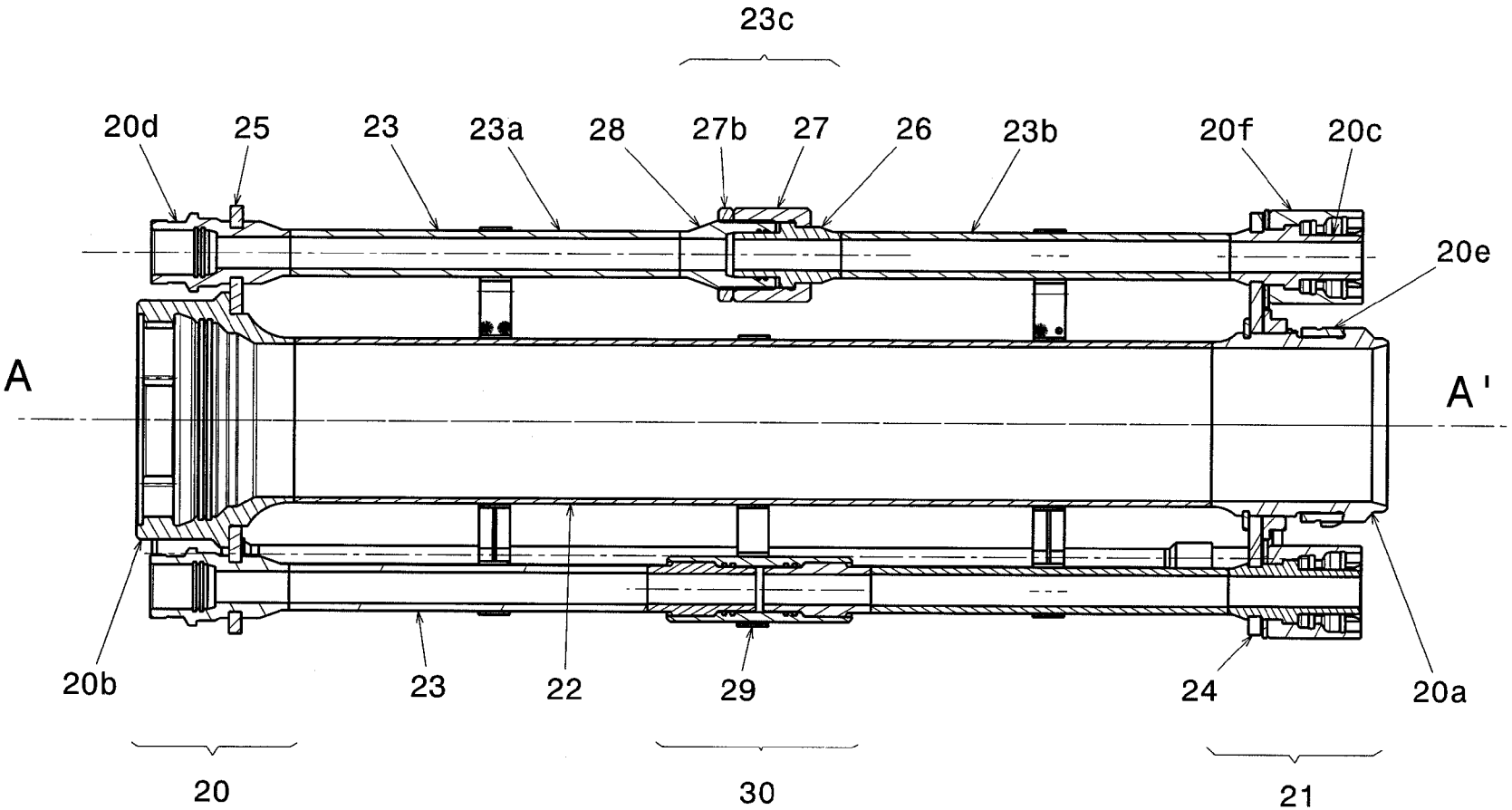
FIG. 3 shows in detail a riser section according to the invention.

FIG. 3 shows a riser section. The section is provided, at one end thereof, with connecting means 20 and, at the other end, with connecting means 21. In order to make up a riser, several sections are assembled end to end, connecting means 20 of a section cooperating with connecting means 21 of another section.

The riser section comprises a main tube element 22 whose axis AA' is the axis of the riser. The auxiliary lines are arranged parallel to axis AA' of the riser so as to be integrated in the main tube. Reference numbers 23 designate the unit elements of the auxiliary lines. An element 23 designates the assembly made up of the tubular portion contained between two connectors 20*c* and 20*d*, as well as the two connectors 20*c* and 20*d*. The length of elements 23 is substantially equal to the length of main tube element 22. There is at least one element 23 arranged on the periphery of main tube 22. If there are several elements 23, they are preferably arranged around tube 22 so as to balance the load transfer of the riser.

Connecting means 20 and 21 consist of several connectors: main tube element 22 and each auxiliary line element 23 are each provided with a mechanical connector. These mechanical connectors can transmit longitudinal stresses from one element to the next. For example, the connectors can be of the type described in documents FR-2,432,672, FR-2,464,426 and FR-2,526,517. These connectors allow two tube sections to be assembled together. With reference to FIG. 3, a main tube connector, respectively an auxiliary line connector, comprises a male tubular element 20*a*, respectively 20*c*, and a female tubular element 20*b*, respectively 20*d*, that fit into one another and have an axial shoulder for longitudinal positioning of the male tubular element with respect to the female tubular element. Each connector also comprises a locking ring mounted mobile in rotation on one of the tubular elements. The ring comprises studs that cooperate with the studs of the other tubular element so as to form a bayonet joint. Ring 20*e* of the main tube connector is mounted to rotate on male tubular element 20*a* and it cooperates with the studs of a female tubular element 20*b* of another riser section. Ring 20*f* is mounted to rotate on male tubular element 20*c* and it cooperates with the studs of a female tubular element 20*d* of another riser section.

Alternatively, the mechanical connectors of auxiliary line elements 23 can also be conventional screwed and bolted joints. These connectors can also be "dog" connectors, i.e. using radial locks. The connectors of auxiliary line elements 23 can also be a male end piece that slides in a female end piece, as described in documents FR-2,799,789 and FR-2,925,105 for example. This type of connector allows a sealed connection to be achieved, without transmitting any longitudinal stresses from one element 23 to another element 23.

According to the invention, an auxiliary line element 23 consists of two parts that are assembled by an adjustable device 23*c* or 30.

For example, element 23 is made up of two tube sections 23*a* and 23*b*, and device 23*c* allows to adjust the axial length of unit assembly 23. In other words, device 23*c* allows to adjust the length of assembly 23 measured between the ends of connectors 20*c* and 20*d*. With reference to FIG. 3, device 23*c* consists of a female end piece 28 welded to tubular part 23*a* and of a male end piece 26 welded to tubular part 23*b*. Female end piece 28 cooperates with male end piece 26 so as to achieve a sealed connection between tube 23*a* and 23*b*. Joints arranged in the annular grooves provided in female element 28 allow to guarantee the tightness of the connection. Furthermore, a nut 27 is screwed onto end piece 28 and rests on an axial shoulder provided on end piece 26 so as to achieve a rigid connection capable of transmitting longitudinal tensile stresses, i.e. in the direction of axis AA'. The longitudinal tensile stresses applied to unit element 23 are transmitted from part 23*a* to part 23*b* via device 23*c*. The screw-nut system consisting of parts 27 and 28 allows to adjust the axial length of unit element 23. In fact, screwing more or less nut 27 allows to increase or to decrease the space along axis AA' between parts 26 and 28, and thus to increase or to decrease the length of unit element 23. When the length of unit element 23 has been adjusted by rotating nut 27, locknut 27*b* can be screwed onto end piece 28. Locknut 27*b* abutting against nut 27 allows to lock in rotation nut 27 with respect to end piece 28, and therefore to lock the position of piece 28 with respect to piece 26.

Figure 4:
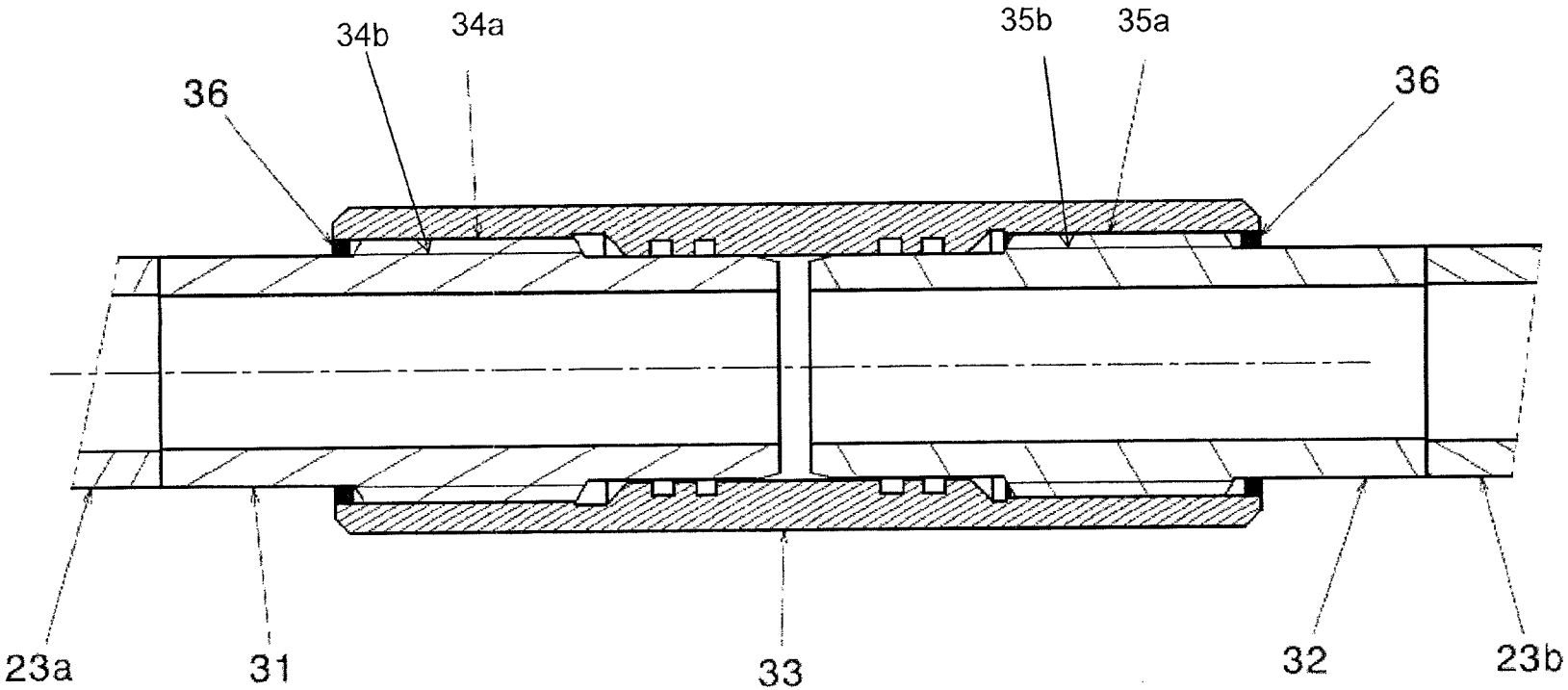
FIG. 4 shows an embodiment variant of a system of assembling two tubular portions according to the invention.

Alternatively, device 30 can be used to assemble the two parts of element 23 together and to adjust the length of unit element 23. Device 30, shown in detail in FIG. 4, consists of tubular end pieces 31 and 32 that are assembled by tubular sleeve 33. End piece 31 is secured to tube part 23*a*, by welding for example. End piece 32 is secured to tube part 23*b*, by welding for example. End piece 31 comprises a threaded art 34*b* on the outer surface thereof, a left-hand thread for example. End piece 32 comprises a threaded part 35*b* on the outer surface thereof, with the thread in the opposite direction with resect to the thread of end piece 31*a* right-hand thread for example. The two ends of sleeve 33 are tapped so as to form opposite hand threads 34*a*, 35*a* that cooperate with the threads 34*b*, 35*b* of end piece 31 and of end piece 32 respectively. End pieces 31 and 32 are screwed onto each end of sleeve 33 so as to assemble the two tube parts 23*a* and 23*b* in order to form a sealed pipe between the two ends of tube 23. The rotation of sleeve 33 about the axis of tube 23 in a predetermined direction allows to screw end pieces 31 and 32 into the sleeve while bringing elements 23*a* and 23*b* closer together. The rotation of the sleeve in the opposite direction allows elements 23*a* and 23*b* to be moved away from one another. It is thus possible to increase or to decrease the length of unit element 23, i.e. the axial length measured between the ends of the two connectors of element 23. Seals 36 can be arranged between the annular spaces between end piece 31 and sleeve 33, and between end piece 32 and sleeve 33. A clamp 29 allows sleeve 33 to be blocked in rotation. Clamp 29 is secured to main tube 22. When the length of assembly 23 is adjusted by rotation of sleeve 33, clamp 29 is tightened on sleeve 33. Thus, sleeve 33 is blocked in rotation with respect to tube 22 and, therefore, the position of end piece 31 is fixed with respect to that of end piece 32. Furthermore, clamp 29 allows tube portions 23*a* and 23*b* to be guided upon assembling and adjusting unit assembly 23.

Without departing from the scope of the invention, adjustable device 23*c* or 30 can be located in different axial positions on unit element 23. In particular, device 23*c* or 30 can be arranged at one end of element 23, for example between the tube and the male element of connector 20*d*, or between the tube and female element 20*c* of the connector.

Figure 5:
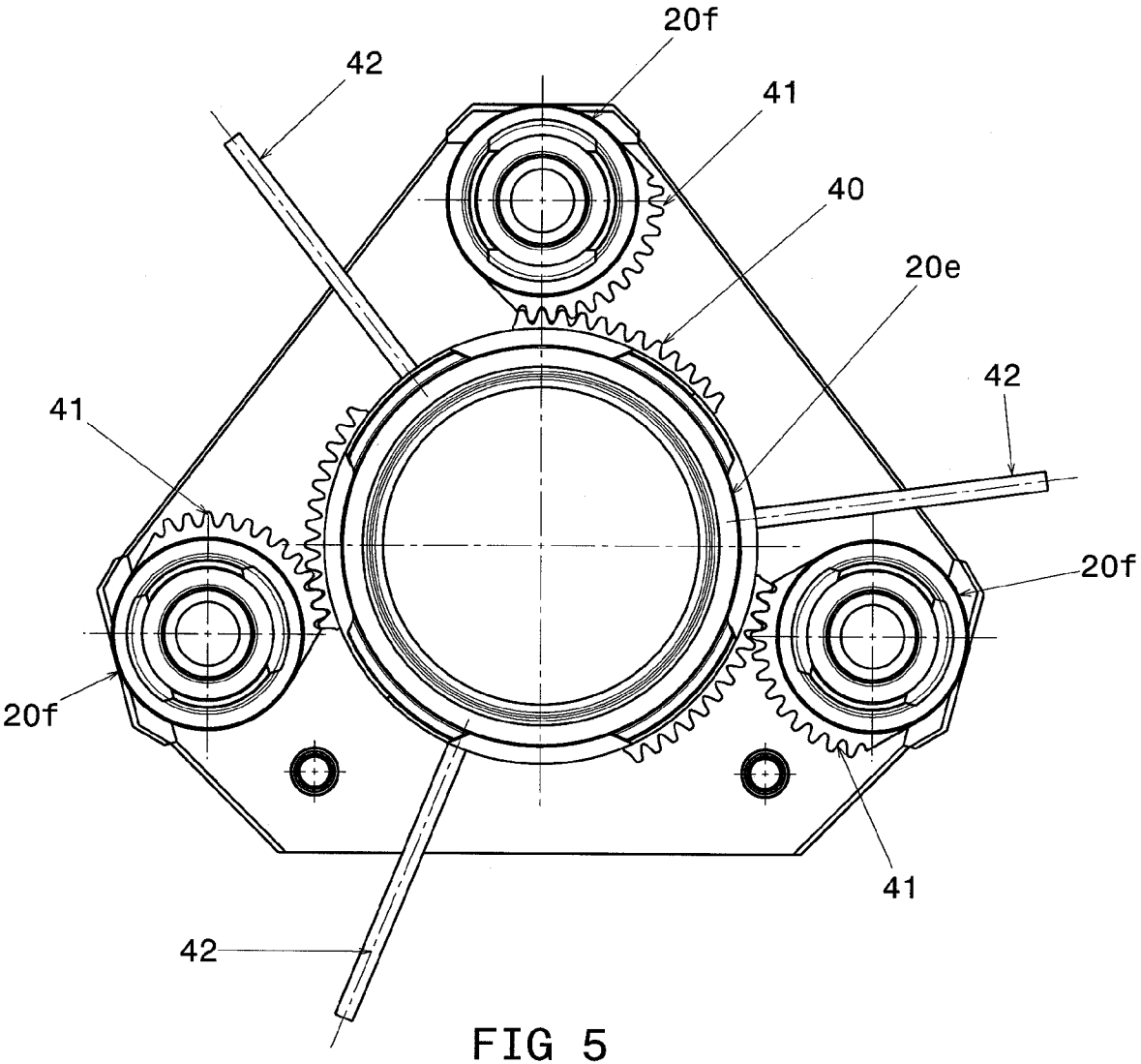
FIG. 5 shows in detail a centralized system for locking the connectors of a riser section according to the invention.

In order to simplify assembly of the riser sections, connecting means 20 and 21 are provided with a locking system that allows the various connectors to be locked by actuating a single part. With reference to FIG. 5, on the one hand, the periphery of locking ring 20*e* of connector 20*a* of main tube 22 is fitted with a toothed crown 40. On the other hand, locking rings 20*f* of each connector 20*c* of auxiliary line elements 23 are fitted with toothed sectors 41 that cooperate with toothed crown 40 of the connector of main tube 22. Thus, when rotating ring 20*f* of the main tube connector around axis AA', toothed crown 40 gears each one of toothed sectors 41 and thus causes rotation of each ring 20*f* of the connectors of auxiliary line elements 23. Toothed crown 40 can be operated by means of grab bars 42 that may be retractable. This system allowing simultaneous locking of the connector of tube 22 with the connectors of elements 23 can be applied to any type of connector using a rotating locking system.

Furthermore, auxiliary line element 23 can be secured to main tube 22. In other words, the riser section comprises fastening means 6 shown in FIG. 2 that allow auxiliary line element 23 to be mechanically fastened to main tube 22. Fastening means 6 position and secure element 23 onto tube 22. For example, with reference to FIG. 3, fastening means 6 comprise plates 24 and 25. Plates 24 and 25 are mounted in an interdependent manner at each end of main tube 22 at the level of connector elements 20*a* and 20*b*. The ends of the auxiliary lines comprise grooves at the level of connector elements 20*c* and 20*d* that fit into hollows provided on the periphery of plates 24 and 25.

Furthermore, in order to produce risers that can operate at depths reaching 3500 m and more, metallic tube elements are used, whose resistance is optimized by composite hoops made of fibers coated with a polymer matrix.

A tube hooping technique can be the technique consisting in winding under tension composite strips around a metallic tubular body, as described in documents FR-2,828,121, FR-2,828,262 and U.S. Pat. No. 4,514,254.

The strips consist of fibers, glass, carbon or aramid fibers for example, the fibers being coated with a polymer matrix, thermoplastic or thermosetting, such as a polyamide.

A technique known as self-hooping can also be used, which consists in creating the hoop stress during hydraulic testing of the tube at a pressure causing the elastic limit in the metallic body to be exceeded. In other words, strips made of a composite material are wound around the tubular metallic body. During the winding operation, the strips induce no stress or only a very low stress in the metallic tube. Then a predetermined pressure is applied to the inside of the metallic body so that the metallic body deforms plastically. After return to a zero pressure, residual compressive stresses remain in the metallic body and tensile stresses remain in the composite strips.

The thickness of the composite material wound around the metallic tubular body, preferably made of steel, is determined according to the hoop prestress required for the tube to withstand, according to the state of the art, the pressure and tensional stresses.

According to another embodiment, tubes 23 that make up the auxiliary lines can be made of an aluminium alloy. For example, aluminium alloys with ASTM (American Standard for Testing and Material) references 1050, 1100, 2014, 2024, 3003, 5052, 6063, 6082, 5083, 5086, 6061, 6013, 7050, 7075, 7055 or aluminium alloys marketed under reference numbers C405, CU31, C555, CU92, C805, C855, C70H by the ALCOA Company can be used.

Alternatively, tubes 23 that make up the auxiliary lines can be made of a composite material consisting of fibers coated with a polymer matrix. The fibers can be carbon, glass or aramid fibers. The polymer matrix can be a thermoplastic material such as polyethylene, polyamide (notably PA11, PA6, PA6-6 or PA12), PolyEtherEther-Ketone (PEEK) or polyvinylidene fluoride (PVDF). The polymer matrix can also be made of a thermosetting material such as epoxys.

Alternatively, tubes 23 that make up the auxiliary lines can be made of a titanium alloy. For example, a Ti-6-4 titanium alloy (alloy comprising, in wt. %, at least 85% titanium, about 6% aluminium and 4% vanadium) or the Ti-6-6-2 alloy comprising, in wt. %, about 6% aluminium, 6% vanadium, 2% tin and at least 80% titanium, can be used.

The invention claimed is:

1. A riser section comprising a main tube, at least one auxiliary line element arranged substantially parallel to said tube, the main tube comprising connecting means allowing longitudinal stresses to be transmitted and the auxiliary line element comprises linking means, characterized in that the auxiliary line element is made up of two parts assembled by an adjustment device, separate from linking means, allowing to modify the axial length measured between the ends of said auxiliary line element.

2. A riser section as claimed in claim 1, characterized in that the adjustment device comprises a screw-nut system.

3. A riser section as claimed in claim 2, characterized in that a nut rests against a shoulder provided on one of the two parts of the auxiliary line element and in that the nut is screwed onto a thread provided on the other part of the auxiliary line element.

4. A riser section as claimed in claim 3, characterized in that a locking means blocks the nut in rotation.

5. A riser section as claimed in claim 1, characterized in that the adjustment device comprises a male end piece and a female end piece, the male end piece cooperating with the female end piece so as to achieve a sealed connection between the two tube sections.

6. A riser section as claimed in claim 1, characterized in that the adjustment device comprises a sleeve including a first internal thread that cooperates with a first thread provided in one of the two parts of the auxiliary line element, the sleeve comprising a second internal thread that cooperates with a second thread provided in the other part of the auxiliary line element, the first thread being reversed with respect to the second thread.

7. A riser section as claimed in claim 6, characterized in that a locking means blocks the sleeve in rotation.

8. A riser section as claimed in claim 6, characterized in that seal means are arranged between the parts of the auxiliary line element and the sleeve.

9. A riser section as claimed in claim 1, wherein the auxiliary line element is secured to the main tube.

10. A riser section as claimed in claim 1, wherein the connecting means consist of a bayonet locking system.

11. A riser section as claimed in claim 1, wherein the linking means allow to transmit longitudinal stresses and they are selected among the group consisting of a bayonet locking system, a screwing system, a "dog" lock system.

12. A riser section as claimed in claim 1, wherein the linking means comprise a male end piece and a female end piece, the male end piece being suited to slide in the female end piece.

13. A riser section as claimed in claim 1, wherein the connecting means comprise a first rotating locking element, the linking means comprise a second rotating locking element, and the rotation of the first locking element causes rotation of the second locking element.

14. A riser section as claimed in claim 10, wherein the bayonet locking system comprises a male tubular element and a female tubular element that fit into one another and have an axial shoulder for longitudinal positioning of the male tubular element in relation to the female tubular element, a locking ring mounted mobile in rotation on one of the tubular elements, the ring comprising studs that co-operate with the studs of the other tubular element so as to form a bayonet joint.

15. A riser section as claimed in claim 1, wherein at least one of the elements selected from the group consisting of the main tube and of the auxiliary line element comprises a steel tube hooped by composite strips.

16. A riser section as claimed in claim 15, wherein said composite strips comprise glass fibers, carbon fibers or aramid fibers coated with a polymer matrix.

17. A riser section as claimed in claim 1, wherein the auxiliary line element is made of a material selected from the list consisting of a composite material comprising reinforcing fibers coated with a polymer matrix, an aluminium alloy, a titanium alloy.

18. A riser comprising at least two riser sections as claimed in claim 1, assembled end to end, wherein an auxiliary line element of a section transmits longitudinal stresses to the auxiliary line element of the other section to which it is assembled.

* * * * *